United States Patent [19]

Moss

[11] 4,386,566

[45] * Jun. 7, 1983

[54] MANDREL ASSEMBLY FOR DEMOUNTABLE PRINTING CYLINDER

[75] Inventor: Lester I. Moss, Hackensack, N.J.

[73] Assignee: Mosstype Corporation, Waldwick, N.J.

[ * ] Notice: The portion of the term of this patent subsequent to May 17, 2000, has been disclaimed.

[21] Appl. No.: 207,976

[22] Filed: Nov. 18, 1980

Related U.S. Application Data

[63] Continuation-in-part of Ser. No. 194,616, Oct. 6, 1980.

[51] Int. Cl.[3] ..... B41F 13/10

[52] U.S. Cl. ..... 101/375; 29/113 R

[58] Field of Search ..... 101/375, 376; 29/113 R, 29/117, 129, 129.5, 116 AD, 113 AD; 242/72 R, 72 B; 279/2 A; 269/48.1

[56] References Cited

U.S. PATENT DOCUMENTS

| | | | |
|---|---|---|---|
| 1,600,692 | 9/1926 | Millspaugh | 101/375 |
| 2,583,117 | 1/1952 | Piperoux et al. | 29/113 R |
| 2,787,956 | 4/1957 | Kirby et al. | 101/375 |
| 2,876,961 | 3/1959 | Cole et al. | 242/72 |
| 2,949,852 | 8/1960 | Schaefer | 101/375 |
| 3,166,013 | 1/1965 | Wyllie et al. | 29/113 R |
| 3,202,432 | 8/1965 | Cameron | 242/72 X |
| 3,217,554 | 11/1965 | Stalker | 29/129.5 X |
| 3,253,323 | 5/1966 | Saueressig | 29/113 R |
| 3,378,902 | 4/1968 | Hoexter | 29/156.4 R |
| 3,388,916 | 6/1968 | Winnen et al. | 279/2 |
| 3,535,760 | 10/1970 | James | 29/113 R |
| 3,762,730 | 10/1973 | Cameron | 242/72 B X |
| 3,770,287 | 11/1973 | Weber et al. | 242/72 |
| 4,050,643 | 9/1977 | Secor | 242/72 R |
| 4,135,677 | 1/1979 | Warczak | 242/72 B |
| 4,147,312 | 4/1979 | Secor et al. | 242/72 R |
| 4,150,622 | 4/1979 | Stollenwerk et al. | 29/113 R X |
| 4,217,821 | 8/1980 | Vertegaal | 101/375 X |

FOREIGN PATENT DOCUMENTS

| | | | |
|---|---|---|---|
| 2815892 | 9/1979 | Fed. Rep. of Germany | 29/113 R |

*Primary Examiner*—J. Reed Fisher

*Attorney, Agent, or Firm*—Michael Ebert

[57] ABSTRACT

A mandrel assembly for a demountable printing cylinder, the assembly including a tube receivable within the cylinder and having journals joined thereto at either end. Encircling each journal is an expansible sleeve, the sleeves fitting within the end heads of the cylinder when it is mounted on the mandrel assembly. Below each sleeve on its journal is a relieved zone defining an annular hydraulic chamber. An axial inlet section which opens into the free end of each journal receives a piston and a tool-operated piston screw, the inlet section leading into an internal duct in axial alignment therewith having a lateral branch communicating with the hydraulic chamber, the duct and chamber being filled with hydraulic fluid. When the piston screw is turned in to advance the piston, the resultant hydraulic pressure is applied through the hydraulic chamber against the inner wall of the sleeve, causing the sleeve to expand and grip the cylinder head, thereby locking the cylinder to the mandrel assembly. When the piston screw is turned out, the pressure is released to permit removal of the cylinder.

5 Claims, 6 Drawing Figures

16
24
27
26
25
18
13
10
12
14
17
15
39
38
37
35
11

MANDREL ASSEMBLY FOR DEMOUNTABLE PRINTING CYLINDER

RELATED APPLICATION

This application is a continuation-in-part of my copending application entitled "Hydraulically-Actuated Mandrel for a Demountable Printing Cylinder," Ser. No. 194,616 filed Oct. 6, 1980.

BACKGROUND OF INVENTION

This invention relates generally to demountable printing cylinders, and more particularly to a mandrel assembly for supporting a demountable cylinder and including a pair of hydraulically-actuated sleeves which are expansible to engage the end heads of the cylinder to lock the cylinder to the mandrel assembly, the assembly being operable in small as well as large diameter sizes.

In gravure printing, use is made of a printing cylinder whose surface is etched with cup-like cells which, as the cylinder passes through an ink fountain, pick up and carry the ink. When the cylinder engages an impression roller, the ink is transferred to the surface of the paper running therebetween. Flexographic printing uses similar inks, but the ink is picked up by rubber printing plates attached to a cylinder.

Since in the course of such printing operations, it is frequently necessary to replace one cylinder by another, various expedients have heretofore been proposed to provide demountable cylinder structures whereby the same mandrel may be coupled to different cylinders for use in the printing machine.

The simplest mechanical expedient for this purpose is set-screws to attach a cylinder to the mandrel. While set-screw arrangements are uncomplicated, they may have serious practical drawbacks. It is difficult to achieve proper concentricity with set screws; and as a consequence, the printing is of poor quality. Moreover, set-screws tend to vibrate and work loose. Other more complicated mechanical locking devices, such as split-lock clamping collars and expanding collets, have been suggested, but these are generally more expensive and equally inaccurate.

One may obtain accurate mounting for printing cylinders using a heat-shrinkage procedure to attach and detach a cylinder to or from a mandrel. This procedure involves end closures on the cylinder having a relatively high coefficient of thermal expansion with respect to the mandrel, and it requires special heating equipment. Not only is the procedure time-consuming, but should axial of side-to-side adjustment of the cylinder on the mandrel be necessary, the heating procedure must be repeated with a further loss of time.

Another known approach makes use of hydraulically-actuated collet locks for demountable cylinders. However, known devices of this type require grease guns to pump fluid into the lock each time a locking action is to be effected, the grease being bled off each time the mandrel is to be released. The use of grease in the environment of printing operations is obviously undesirable. Moreover, it is not possible with such known devices to determine, without the use of additional expedients, the amount of hydraulic pressure that is being imposed on the mandrel, and whether it is sufficient to afford adequate torque resistance. As a consequence, cylinder creep or slippage may be encountered in the course of printing, with deleterious effect.

The Hoexter U.S. Pat. No. 3,378,902 discloses a printing cylinder having a pair of hydraulically-actuated collets mounted at opposing ends thereof, the mandrel for supporting the cylinder being slidably receivable within the collets and securely locked thereto when hydraulic pressure is applied. Each collet includes a cylindrical sleeve having a thick-walled hub section and a relatively long thin-walled pressure section. A broad circumferential channel is cut in the pressure section to form a bendable pressure wall, the pressure section being surrounded by a collar of high tensile strength whose edges are welded to the pressure section to define an annular fluid chamber bounded by the collar and the pressure wall.

A pressure cartridge is fitted into a cavity in the hub action, the cartridge communicating with the fluid chamber in the pressure section and including a piston which is advanced inwardly by an adjusting screw. When the annular chamber is filled with hydraulic fluid and the piston is advanced inwardly, the resultant hydraulic pressure causes flexure of the pressure wall, thereby subjecting the mandrel to radially-directed stresses which are uniformly distributed and serve to lock the mandrel to the collet and at the same time to maintain proper concentricity.

In the Hoexter arrangement, the mandrel is a standard shaft, but the demountable cylinder is not of standard design. It is a special cylinder which includes a pair of hydraulically-actuated and collets, as described above. Hence the special cylinder is substantially more expensive to manufacture than a standard cylinder. Since each machine in the printing facility is provided with several special cylinders each operable with a common mandrel, the overall cost of this arrangement is high.

The three piece mandrel assembly disclosed in my aboveidentified copending application has distinct practical advantages for it is useable with low cost standard demountable printing cylinders rather than with a more costly printing cylinder of unconventional design. This mandrel assembly is composed of a tube having journals joined thereto, the journals extending axially from either end of the tube.

Encircling each journal at the position thereon adjacent the end of the tube is an expansible sleeve whose normal dimensions are such that the sleeve fits neatly within the corresponding end head of the printing cylinder to be mounted on the assembly. Each journal is relieved just below the sleeve thereon to define an annular hydraulic chamber. Formed in the journal in a region adjacent the sleeve is a lateral bore within which is received a piston and a piston screw. When turned in, the screw causes the piston to advance, this advance serving to apply pressure to a hydraulic fluid filling an internal duct which communicates with the hydraulic chamber. As a consequence of this hydraulic pressure, the sleeve surrounding the chamber is caused to expand to grip the associated and head on the printing cylinder and thereby locking the cylinder to the mandrel assembly.

The internal duct disclosed in my copending application is displaced from the central axis of the journal, whereas the lateral bore which houses the piston and piston screw is at right angles thereto. The duct and bore arrangement in the journal is relatively difficult to machine. Moreover, this arrangement is not feasible for small diameter mandrel assemblies, such as one having a two and a half inch maximum diameter, for then the available space is insufficient to permit adequate piston advance in the lateral bore to develop the necessary hydraulic pressure.

Another drawback of my prior mandrel assembly in which a piston operates at right angles to the off-center duct filled with hydraulic fluid, this in turn being linked by right angle branches to the annular hydraulic chamber, is that the resultant fluid path has several sharp bends. It is not always possible with this angled path to fully bleed the air from the hydraulic system, for pockets of air may become trapped in cavities created at the bends. The bleeding of air is essential, for air is compressible and interferes with the proper action of the incompressible hydraulic fluid.

SUMMARY OF INVENTION

In view of the foregoing, the main object of this invention is to overcome the limitations of the assembly disclosed in my copending application by providing a mandrel assembly useable with standard demountable printing cylinders, the assembly being operable in small as well as larger diameter sizes.

A significant advantage of a three-piece mandrel assembly in accordance with the invention is that it may be manufactured without difficulty at relatively low cost in all useful diameters so that mandrel assemblies may be produced for the full range of commercially available printing cylinders.

More particularly an object of this invention is to provide a mandrel assembly of the above type wherein the duct containing the hydraulic fluid and the inlet section thereto housing the piston and the piston screw to apply pressure to the fluid are formed axially in the journals, thereby simplifying manufacturing procedures, this straight line arrangement avoiding air pockets in the hydraulic system.

Briefly stated these objects are attained in a three-piece mandrel assembly for supporting a demountable standard printing cylinder in a printing machine, the cylinder having end heads at either end thereof. The assembly is constituted by a tube receivable within the cylinder and journals joined to opposing ends of the tube and extending axially therefrom for insertion in the bearings of the printing machine.

Each of the journals has an expansible sleeve pinned thereon whose normal diameter is such that the sleeve fits within a respective end head of the cylinder. The sleeve surrounds and encloses an annular hydraulic chamber formed on the journal, the chamber communicating with an internal duct extending axially in the journal and filled with hydraulic fluid. This duct is provided with an inlet section in line therewith which houses a slidable piston and a piston screw, the inlet section having a mouth opening into a free end of the journal to afford access to the screw.

When the screw is turned in, the resultant hydraulic pressure is transmitted by the fluid to the sleeve to effect expansion thereof, causing the sleeve to grip the cylinder head and lock the printing cylinder to the mandrel assembly.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
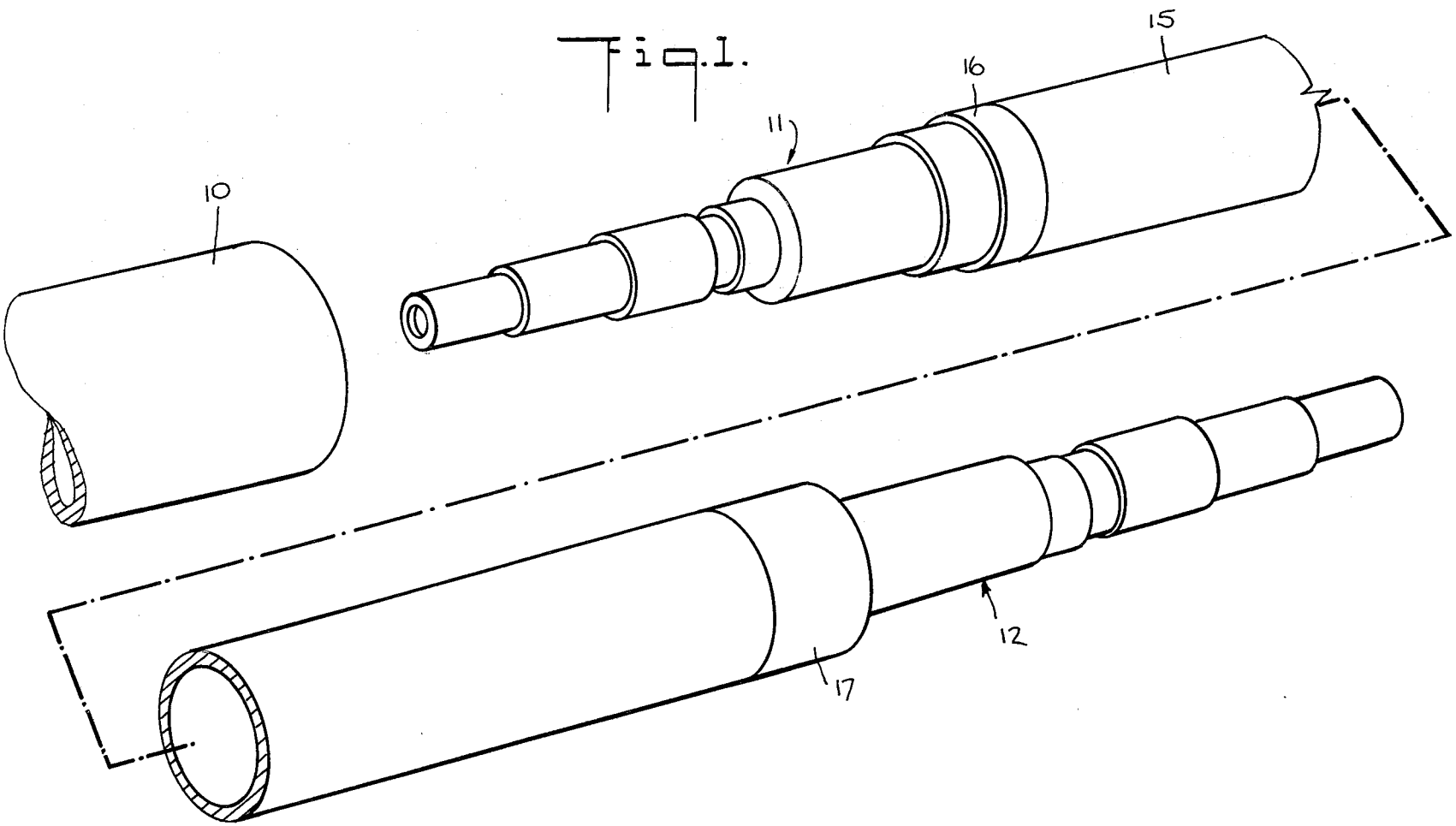
FIG. 1 is a perspective view of a mandrel assembly in accordance with the invention adapted to support a standard demountable printing cylinder.
Figures 2, 5, 6:
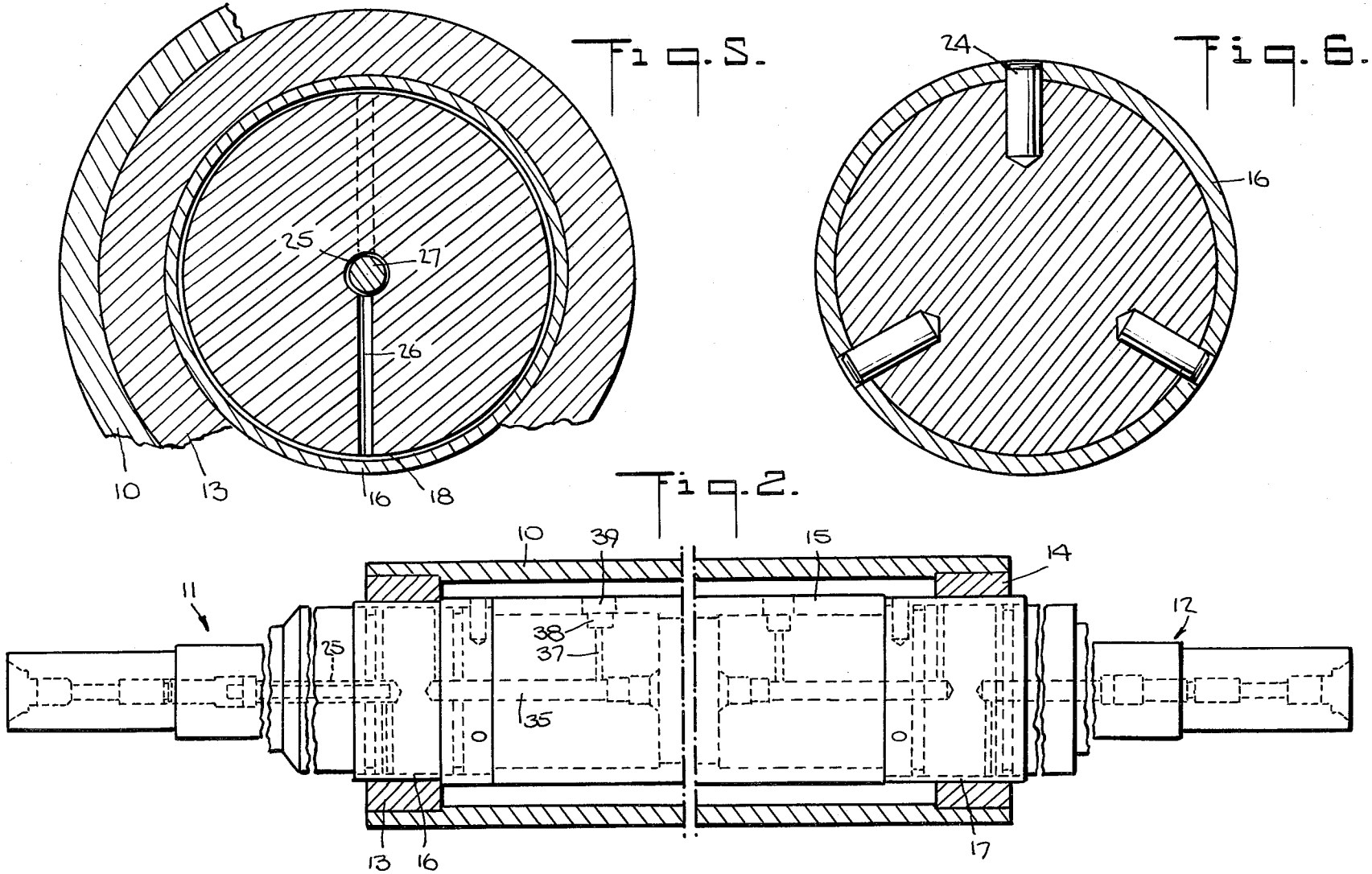
FIG. 2 is a longitudinal section taken through the mandrel assembly.
FIG. 5 is a transverse section taken in the plane indicated by lines 5—5 in FIG. 3.
FIG. 6 is a transverse section taken in the plane indicated by lines 6—6 in FIG. 3.

Referring now to FIG. 1, there is shown a gravure or flexographic printing cylinder 10 releasably mounted on a mandrel assembly in accordance with the invention supported for rotation within a printing press. The assembly includes left and right journals 11 and 12 which are received in suitable bearings in the printing machine for which it is intended. Cylinder 10 is of standard design and is of uniform circular cross section. As best seen in FIG. 2, cylinder 10 is provided with end heads 13 and 14 having circular bores.

Journals 11 and 12 each include a leading section (11A and 12A) that is shrunk-fit into the opposite ends of a metal connecting tube 15. Thus the mandrel assembly is composed of three pieces, tube 15 and journals 11 and 12 joined to either end and extending axially therefrom.

The intermediate portion of each journal which adjoins the end of tube 15 is encircled by an expansible sleeve. Thus left journal 11 is provided with a sleeve 16 and right journal 12 with a sleeve 17, the sleeves being preferably made of steel. It will be seen that sleeve 16 is provided with a shoulder to form a stop for its associated cylinder end head. The parameters are such that the outside diameter of each sleeve in the unexpanded state is substantially equal to that of the end head bore in which it is received; hence the cylinder is readily mounted thereover, as shown in FIG. 2. The length of the mandrel assembly measured from sleeve to sleeve is about equal to the length of the printing cylinder. Hence when the cylinder is mounted, sleeves 16 and 17 lie within end heads 13 and 14 respectively, of the cylinder.

Figure 3:
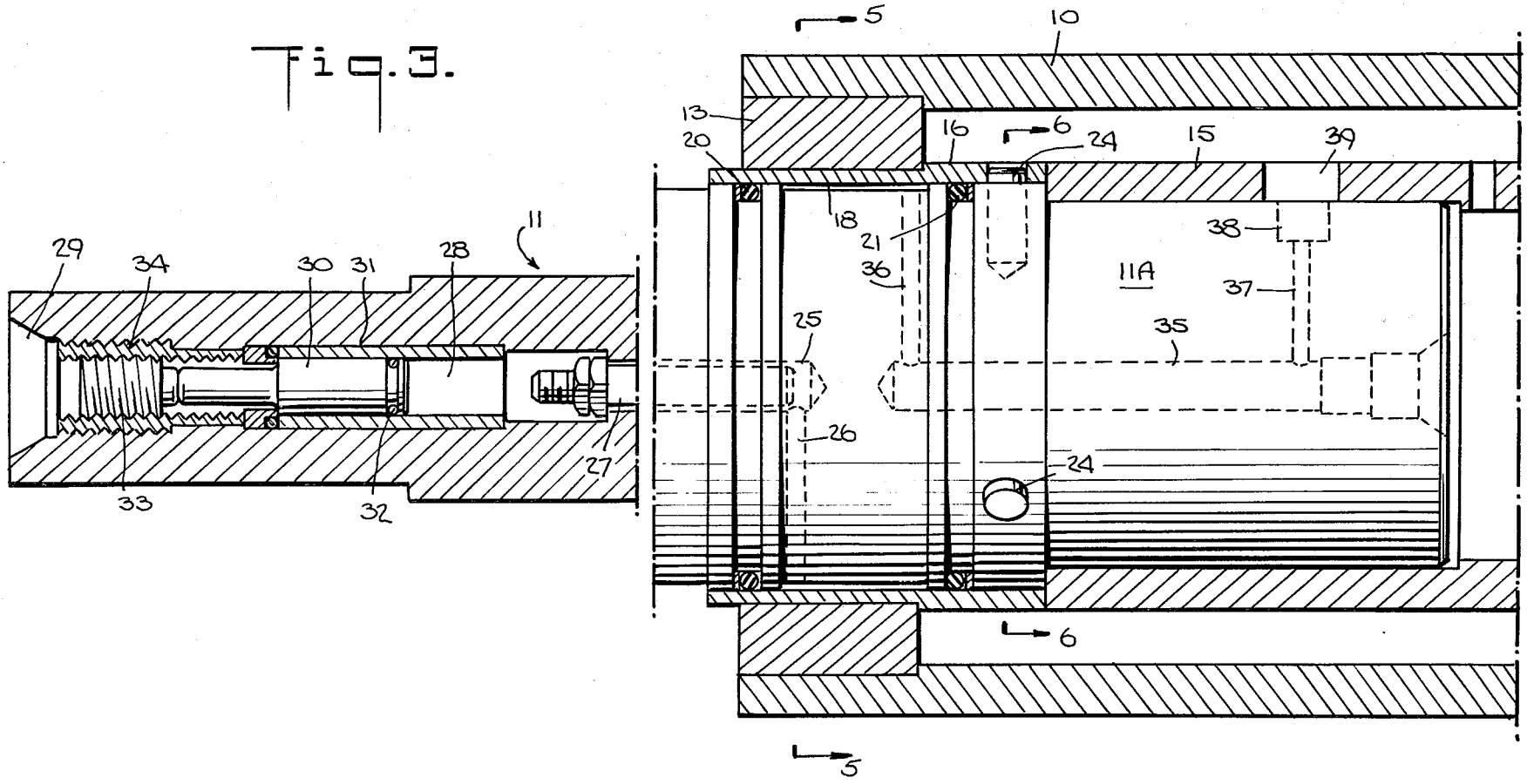
FIG. 3 is an enlargement of the left journal of the assembly.
Figure 4:
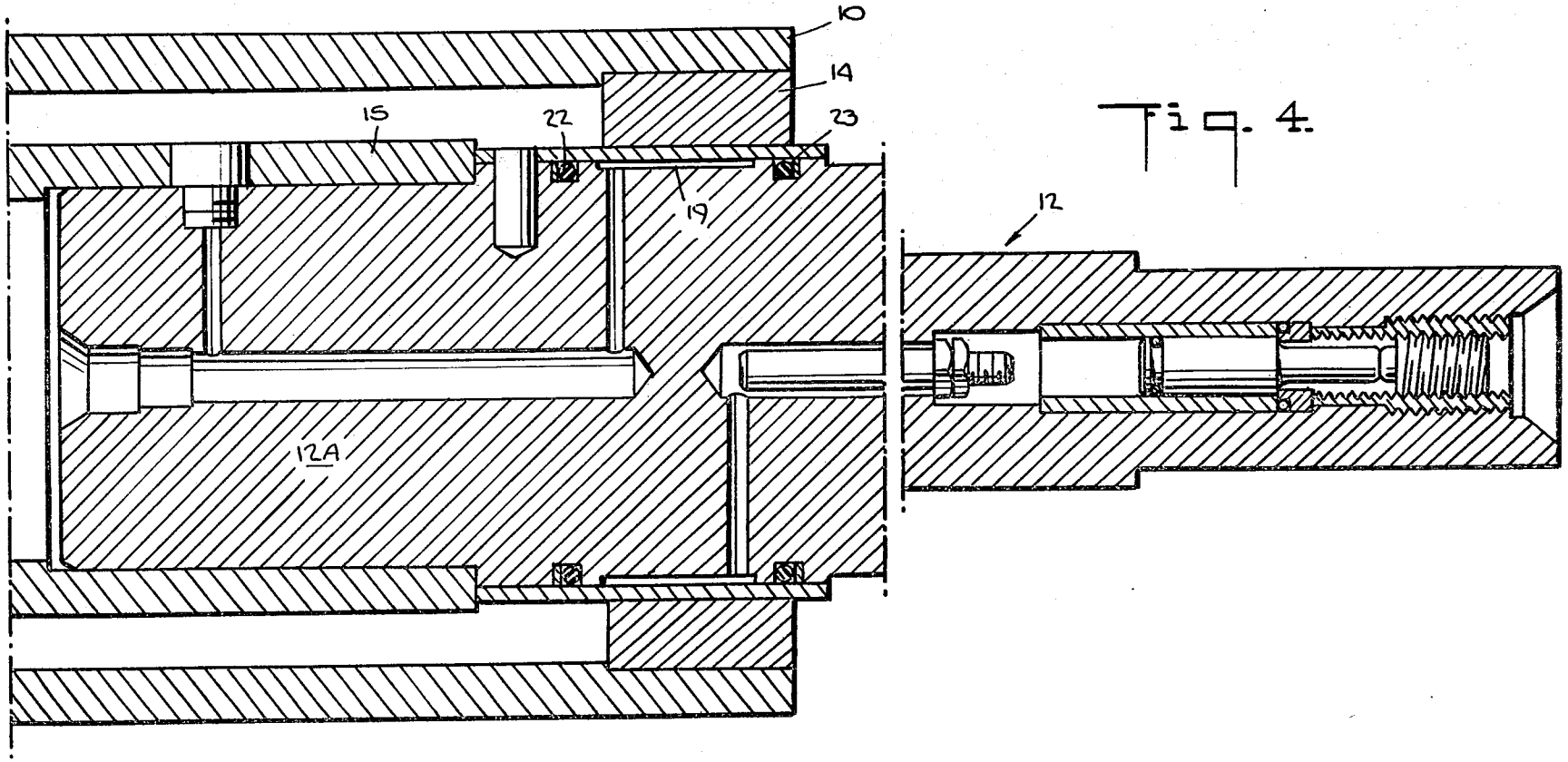
FIG. 4 is an enlargement of the right journal of the assembly.

The journals are machined to relieve a zone underlying sleeves 16 and 17 to define annular hydraulic chambers 18 and 19 respectively, as shown in FIGS. 3 and 4. On either side of these chambers, annular grooves are formed which in journal 11 are occupied by O-rings 20 and 21 and in journal 12 by O-rings 22 and 23. These rings provide seals preventing oil leakage when the sleeves are expanded. In each of these grooves, there is also a back-up ring. As best seen in FIGS. 3 and 6, sleeve 16 is retained on journal 11 by a set of three pins 24 at equi-angular positions, sleeve 17 being similarly pinned to journal 12.

Since the two journals include identical hydraulic systems, we shall now describe in detail only that included in left journal 11. In this journal, as best seen in FIG. 3, there is an internal main duct 25 which extends axially therein, the inner end of this duct communicating with hydraulic chamber 18 through a lateral branch 26 which opens into the chamber at the left side thereof. Coaxially supported within duct 25 is a plug 27 which serves to provide a restricted annular passage therein for the hydraulic fluid which fills duct 25, the branch 26 and chamber 18.

Main duct 25 leads into an axial inlet section 28 whose conical mouth 29 opens into the free end of journal 11. Received within inlet section 28 is a piston 30 that is slidable within a tubular insert 31, the head of this piston being provided with an "O" ring 32 to provide a seal against oil leakage through the inlet section. Piston 30 is actuated by a piston screw 33 received within an internally-threaded collar 34, access to the screw being had through mouth 29 of the inlet section.

Also formed in journal 11 is a bleed duct 35 which extends axially into the leading section 11A of the journal, this duct terminating at the inner end of the journal where it is permanently plugged after being machined. The inner end of bleed duct 35 is provided with a lateral branch 36 which leads into the right side of hydraulic chamber 18, branch 36 of bleed duct 35 extending in a direction diametrically opposed to branch 26 of the main duct 25. Bleed duct 35 is also provided with an auxiliary lateral branch 37 which leads to a socket 38 that lies below an opening 39 in connecting tube 15 of the mandrel, socket 38 being adapted to accommodate a removable stopper or seal.

Thus the hydraulic line is balanced with respect to hydraulic chamber 18, the fluid passage extending from main duct 25 into the left side of the chamber and extending from the right side of the chamber into bleed duct 35. When this line is first charged with fluid, the stopper in seal socket 38 is unplugged to permit the flow of fluid through the line until all air is expelled from the line, after which the stopper is put in place.

Thereafter by turning in piston screw 33, the resultant hydraulic pressure is transmitted to hydraulic chamber 18 in the left journal to cause expansions of sleeve 16 which acts to grip cylinder head 13 to lock the cylinder to the mandrel assembly. The structure and operation of the hydraulic system in the right journal is exactly the same.

While there have been shown and described preferred embodiments of a mandrel assembly for demountable printing cylinder in accordance with the invention, it will be appreciated that many changes and modifications may be made therein without however departing from the essential spirit thereof.

I claim:

1. The combination of a mandrel assembly and a standard printing cylinder of predetermined diameter and length supported thereby in a printing machine having bearings, said cylinder having annular end heads projecting radially inward from the inner surface of the cylinder fitted into either end thereof provided with circular bores coaxial with the cylinder and being demountable on said assembly, said assembly comprising:

A. a tube having a smaller diameter and length than said cylinder receivable within said cylinder between said end heads;

B. journals joined to opposing ends of the tube and extending axially therefrom for insertion in said machine bearings, each journal having an expansible metal sleeve pinned thereon whose normal diameter is such that the sleeve fits into a respective end head bore of the cylinder, said sleeve surrounding as annular hydraulic chamber formed on said journal, said chamber communicating with an axially-extending main internal duct filled with hydraulic fluid and having an inlet section in line therewith whose mouth opens into the free end of the journal, said journal having a leading section which is shrunk fit onto an end of said tube and an intermediate section which is surrounded by said sleeve to define said annular hydraulic chamber, said intermediate section having grooves on either side of said chamber in which "O" rings are received to effect a seal preventing leakage of said fluid when said sleeve is expanded; and C. a piston slidable in said inlet section and a piston screw therein which is accessible through said mouth, the screw when turned in advancing said piston to produce hydraulic pressure which is transmitted through said chamber to said sleeve to cause expansion thereof whereby the sleeve grips said end head to lock the cylinder to the mandrel.

2. An assembly as set forth in claim 1, wherein said sleeve is fabricated of steel.

3. An assembly as set forth in claim 1, wherein said journal further includes an axially-extending bleed duct filled with hydraulic fluid and communicating through a lateral branch with a sealable socket which registers with an opening in said connecting tube to permit bleed of fluid therefrom.

4. An assembly as set forth in claim 3, wherein said main duct communicates with one side of said chamber through a lateral main branch and said bleed duct communicates with the other side of said chamber through a lateral bleed branch.

5. An assembly as set forth in claim 1, wherein said main duct has a plug coaxially supported therein to define an annular restricted passage for said hydraulic fluid.

* * * * *

UNITED STATES PATENT AND TRADEMARK OFFICE

CERTIFICATE OF CORRECTION

PATENT NO. : 4,386,566

DATED : June 7, 1983

INVENTOR(S) : Lester I. Moss

It is certified that error appears in the above-identified patent and that said Letters Patent is hereby corrected as shown below:

Column 6, line 13, "as" should read -- an --.

Signed and Sealed this

*Twenty-seventh* Day of *September 1983*

[SEAL]

*Attest:*

GERALD J. MOSSINGHOFF

*Attesting Officer*

*Commissioner of Patents and Trademarks*